United States Patent [19]

Hattori

[11] Patent Number: 4,502,803

[45] Date of Patent: Mar. 5, 1985

[54] REVERSIBLE INK RIBBON FEED MECHANISM

[75] Inventor: Shigenori Hattori, Aichiken, Japan

[73] Assignee: Brother Kogyo Kabushiki Kaisha, Nagoya, Japan

[21] Appl. No.: 238,227

[22] Filed: Feb. 26, 1981

[30] Foreign Application Priority Data

Feb. 29, 1980 [JP] Japan ..... 55-26892[U]

[51] Int. Cl.[3] ..... B41J 33/48; B41J 33/514

[52] U.S. Cl. ..... 400/219.2; 400/220

[58] Field of Search ..... 400/208, 219.2, 220, 400/220.1, 220.2

[56] References Cited

U.S. PATENT DOCUMENTS

| | | | |
|---|---|---|---|
| 715,456 | 12/1902 | Burk | 400/220.1 X |
| 796,024 | 8/1905 | Wales | 400/219.2 |
| 1,303,159 | 5/1919 | Browning | 400/220.2 X |
| 1,385,547 | 7/1921 | Hokanson | 400/219.2 |

*Primary Examiner*—Ernest T. Wright, Jr.

*Attorney, Agent, or Firm*—Leydig, Voit, Osann, Mayer & Holt, Ltd.

[57] ABSTRACT

The ink ribbon feed mechanism comprises a pair of spool shafts adapted for carrying ribbon spools, a pair of feed pawls selectively engaged with one of the ratchet wheels on said spool shafts for imparting intermittent rotation to the spool shafts, and a reverse mechanism for changing the engaging state of the feed pawls relative to the ratchet wheels. The reverse mechanism includes a first member movable from one to the other direction through a connecting member which is adapted to rotate in unison with the ratchet wheel in dependence upon an operation of a sensor for indicating that reversal of the ribbon take-up direction is required, a second member movable from one to the other position after travel of the first member through a predetermined distance, for changing the engaging state of the feed pawl, and first and second detent members being provided for positioning the members in their two positions. The second movable member is forcibly movable from one to the other position at the same time that the first member is moved from one to the other position by cooperation of the first member and the first detent member, whereby the engaging state of the pair of feed pawls relative to the ratchet wheels may be smoothly changed for reversing the ink ribbon take-up direction.

4 Claims, 9 Drawing Figures

REVERSIBLE INK RIBBON FEED MECHANISM

BACKGROUND OF THE INVENTION

This invention relates to an ink ribbon feed mechanism for use with typewriters, calculating machines or other office machines and, more particularly, to such ink ribbon feed mechanism wherein the ink ribbon take-up or wind-up direction may be automatically reversed in dependence upon completion of take-up of the ink ribbon from one spool to the other spool, as sensed by sensors, said spools being mounted separately on a pair of spool shafts.

The ink ribbon feed mechanism of the above type has been known in the art. In a representative mechanism of this kind, reversal of take-up direction for the ink ribbon is sensed by a sensor, and the reverse mechanism is moved from one to the other position by the medium of a connecting member for selecting the altered engaging state of a pair of feed pawls relative to sprocket wheels that are mounted on a pair of spool shafts. However, in this kind of ink ribbon feed mechanism, there are problems with reliability of the reverse mechanism which can become locked at an intermediate position between two positions, whereby the smooth reversal of the ink ribbon take-up direction may be impeded.

SUMMARY OF THE INVENTION

In view of the above, it is a principal object of the present invention to eliminate these defects of the conventional mechanism.

According to a preferred embodiment of the present invention, there is disclosed an ink ribbon feed mechanism which is provided with a reverse mechanism including a pair of movable members and a pair of positioning members. The first movable member is mounted for movement from one to the other position thereof in accordance with sensor operation and to be positioned in either of the respective positions by operation of a first detent member. The second movable member has a projection that may be engageable with a pair of feed pawls, is movable between two positions so that it may be moved in unison with the first member after movement of said first member through a predetermined distance, and is positioned in either of said two positions by operation of said second positioning member. Thus, the first member is forcibly moved from the one to the other position by cooperation of a connecting member and the first detent member, at the same time that the second member is moved from the one to the other position by cooperation of the first member and the second detent member. Hence, the engaging state of the pair of feed pawls relative to ratchet wheels that are mounted on a pair of spool shafts, may be smoothly changed, for reliably reversing the take-up direction for the ink ribbon.

DETAILED DESCRIPTION OF THE PREFERRED EMBODIMENT

Figure 1:
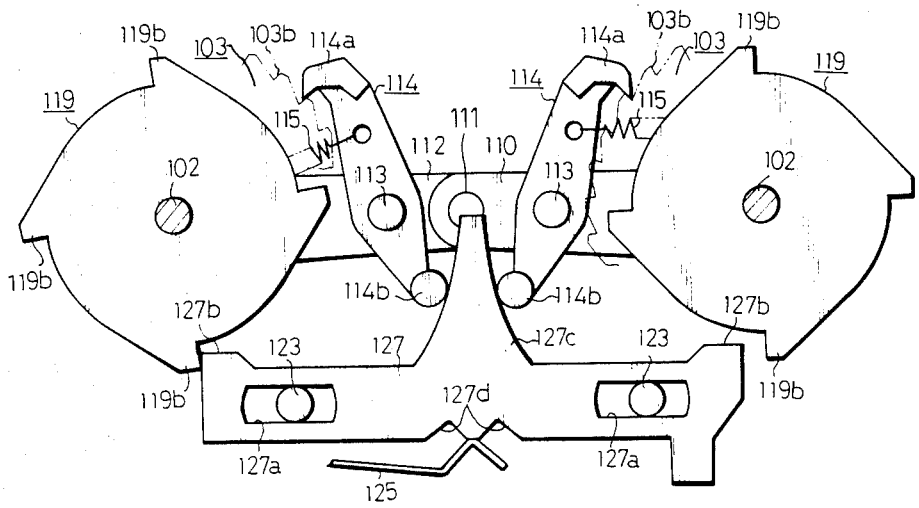
FIG. 1 PRIOR ART
FIG. 1 is a plan view showing a conventional ink ribbon feed mechanism.

FIG. 1 shows a conventional ink ribbon feed mechanism wherein a pair of spool hubs 103 each carrying a ribbon spool are provided with ratchet wheels **103*b* and are rotatably carried by studs 102 on a supported base plate. A pair of feed pawls 114 have a pawl portion 114*a* and an engaging lug 114*b* respectively and are rotatably supported by studs 113 on actuating levers 110, 112. One end of each of said actuating levers 110, 112 is rotatably supported by one of said studs 102, and the other ends of said actuating levers 110, 112 are operatively connected to each other by a pin 111. The pawls 114 are biased by springs 115 for engaging with corresponding ones of the ratchet wheels 103*b*. A pair of connecting members 119 are rotatably supported by said studs 102, and each of the connecting members 119 has a plurality of teeth 119*b* on a peripheral surface thereof. Each of the connecting members 119 is adapted to rotate in unison with a respective ratchet wheel 103*b*** in dependence upon the operation of a sensing means for indicating that reversal of the ribbon take-up direction is required.

There is also provided a reverse mechanism consising of a member 127 and a leaf spring 125. The member 127 is slidably carried on the base plate by cooperation of shafts 123 and elongated slots **127*a* so that said member 127 is allowed to slide between two positions thereof. The member 127 is also provided with a pair of portions 127*b* each engageable with the tooth 119*b* of a respective connecting member 119, a projection 127*c* engageable with the lug 114*b* of a respective feed pawl 114 and a pair of notches 127*d* engageable with the leaf spring 125**.

Thus, when the member 127 is located in one of the two positions, one of the feed pawls 114 is normally disengaged from the corresponding ratchet wheel **103*b* upon the engagement of the projection 127*c* of the member 127 and the lug 114*b* of the feed pawl 114, and the other feed pawl 114 is engaged with the corresponding ratchet wheel 103*b* because the projection 127*c* of the member 127 is not in engagement with the lug 114*b* of the other feed pawl 114. In this state, the ink ribbon is intermittently wound from one of the spools as a supply spool to the other spool as a take-up spool by reciprocating movement of the actuating lever 110, 112. When the sensing means senses the absence of the ribbon on the supply spool, the connecting member 119 is driven into rotation with the ratchet wheel 103*b* upon the sensing movement of the sensing means so that the member 127 is moved from the one position towards the other position by operation of one of the teeth 119*b*. Thereby the relation of the engaging or disengaging state between the respective feed pawls 114 and the ratchet wheels 103*b*** corresponding thereto is changed.

When the member 127 is moved into an intermediate position between the two positions, however, the projection 127*c* may simultaneously engage with the lugs 114*b* of the two feed pawls 114, and also the pawl portions 114*a* of the two pawls 114 may simultaneously engage with the teeth of the corresponding ratchet wheels 103*b*. In this state, both spools tend to serve as take-up spools, and both of the feed pawls 114 and the member 127 are locked in this state. As a result, the engaging state of the feed pawl 114 with the ratchet wheel 103*b* may not be switched over and hence reversal of the take-up direction of the ink ribbon is not performed.

Such inconvenience may be completely avoided by the novel ink ribbon feed mechanism of the present invention, as described below.

Figure 2:
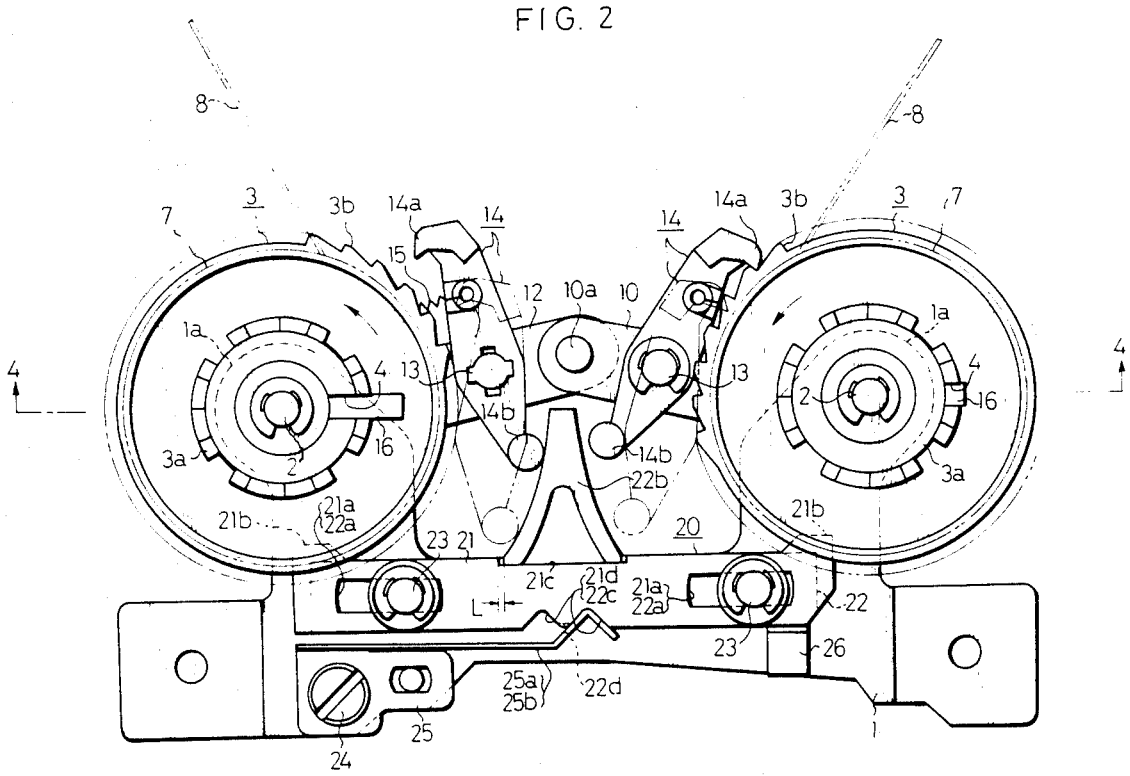
FIG. 2 is a plan view of an ink ribbon feed mechanism embodying the present invention.
Figure 3:
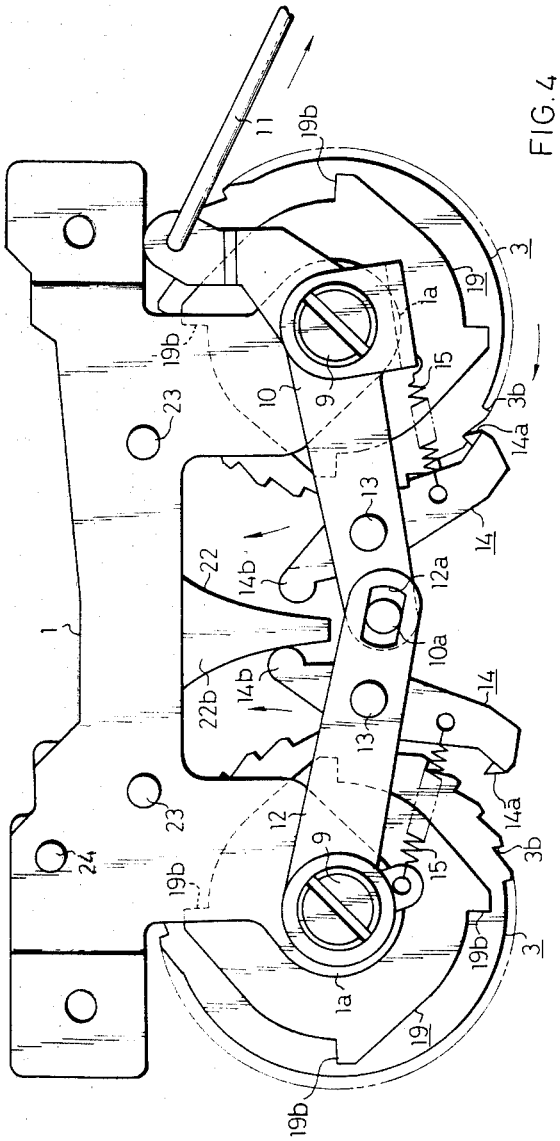
FIG. 3 is a bottom view of the mechanism shown in FIG. 2.
Figure 4:
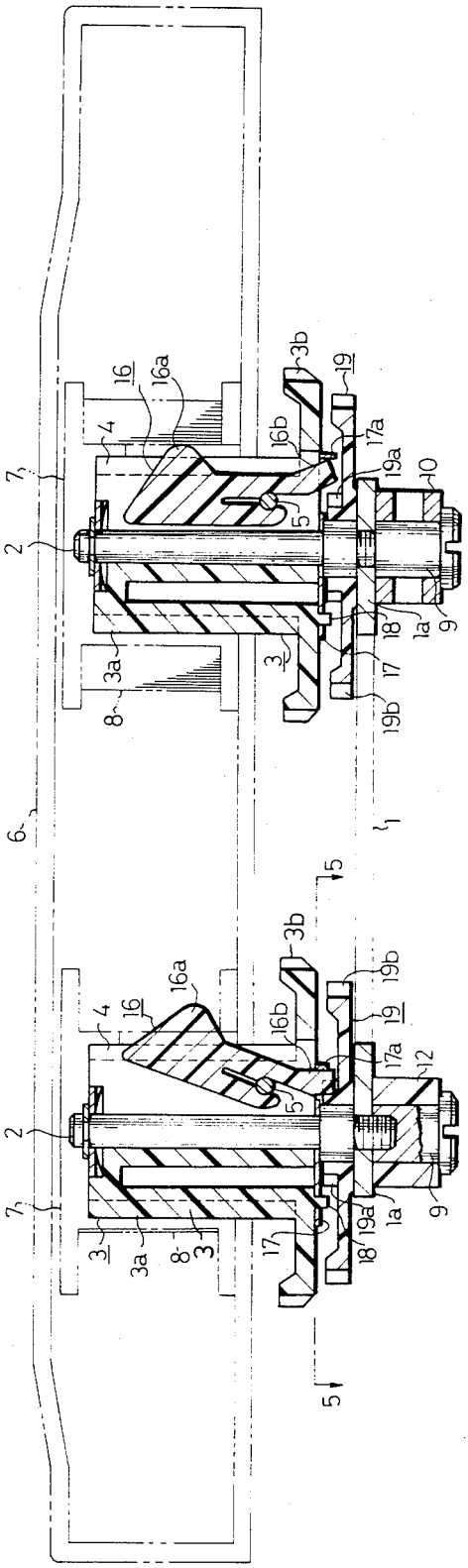
FIG. 4 is a sectional view taken along line 4—4 of FIG. 2.

As shown in FIGS. 2 to 4, a base plate 1 secured to a typewriter frame (not shown) has a pair of extending portions 1*a*, each of which has a stud 2.A pair of spool hubs 3 are rotatably mounted on these studs 2, and each of said spool hubs 3 comprises a spool fitting portion 3*a* and a ratchet wheel 3*b*. The groove 4 extending longitudinally is formed on one side of each of said spool hubs 3, and in the groove 4 is secured a pin 5. As shown in FIG. 4, a ribbon cassette 6 is removably mounted on the spool hubs 3. A pair of spools 7, mounted in the cassette 6, are respectively adapted to be fitted onto the fitting portions 3*a* of the spool hubs 3. An ink ribbon 8 carried on the two spools 7 is adapted to be partially exposed outside the ribbon cassette 6 and to be conducted to a printing position on the front surface of the platen by a vibrating device (not shown).

As shown in FIG. 3, first actuating lever 10 is rotatably carried, at an intermediate portion thereof, on the lower surface of one of the extending portions 1*a* by a support shaft 9, and has a pin 10*a* projected at one end thereof. A connecting rod 11 operatively associated with a typewriter printing mechanism is engaged by the other end of the first actuating lever 10. Second actuating lever 12 is rotatably carried, at the base end thereof, by a support shaft 9 on the lower surface of the other extending portion 1*a* and has an elongated slot 12*a* at the foremost part thereof for insertion of the pin 10*a* of the first actuating lever 10. Thus, the two actuating levers 10, 12 are operatively connected to the printing mechanism and are reciprocated through connecting rod 11.

A pair of feed pawls 14 are, respectively, rotatably carried by studs 13 on the upper surfaces of the first and second actuating levers 10, 12. One end of each feed pawl 14 is provided with pawl portion 14*a* engageable with the ratchet wheel 3*b* mounted on the respective spool hub 3, the other end of the feed pawl 14 being formed with a lug 14*b*. A pair of springs 15 are provided between the first actuating lever 10 and one of the feed pawls 14 corresponding thereto and between the second actuating lever 12 and the other of the feed pawls 14 for respectively biasing the feed pawls 14 into engagement with the corresponding ratchet wheels 3*b*. Each of the feed pawls 14 is selectively engageable with the corresponding ratchet wheel 3*b* by a reverse mechanism 20, to be described later, as shown in FIG. 2. Accordingly, when the feed pawls 14 are driven by reciprocating movement of the actuating levers 10,12, the ratchet wheel 3*b* engaged with the selected one of the feed pawls 14 is rotated by a predetermined extent for winding the ink ribbon 8 on the associated spool 7.

Figure 5:
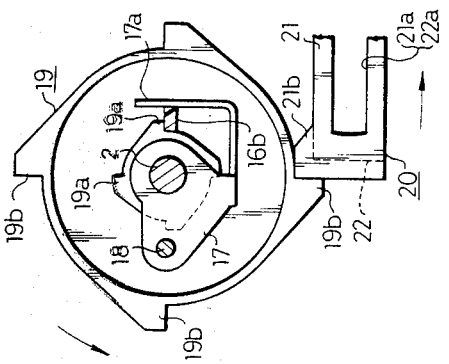
FIG. 5 is a partial sectional view taken along line 5—5 of FIG. 4.

As shown in FIGS. 2 and 4, each of a pair of sensors 16 is rotatably mounted on the pin 5 in the groove 4 of the respective spool hub 3, and is formed at the upper portion thereof with sensing projection 16*a* which may be projected outwardly through the respective groove 4 of the respective spool hub 3. Each of the sensors 16 is also formed at the lower portion thereof with a leg 16*b* that is extended below the respective spool hub 3. As shown in FIGS. 4 and 5, a pair of leaf springs 17 are rotatably fitted to the respective studs 2 at the lower portions of the spool hubs 3 and are connected to the hubs 3 for rotation in unison therewith by projections 18 formed on the lower surfaces of the spool hubs 3. Each leaf spring 17 is provided with an operating portion 17*a* to be engaged with the leg 16*b* of the sensor 16 for biasing the sensor 16 clockwise as shown in FIG. 4.

When sufficient ink ribbon 8 is wound on the spool 7 of the spool hub 3, the projection 16*a* of the sensor 16 is pressed inwardly by the ink ribbon 8, the sensor 16 being held at the position within the groove 4 against the biasing force of the leaf spring 17 as shown at the right-hand side of FIG. 4. When all of the ink ribbon 8 is fed off of the spool 7 on one spool hub 3, the sensor 16 is rotated by the leaf spring 17, where the sensing projection 16*a* of the sensor 16 is moved externally of the slot 4 as shown at the left-hand side of FIG. 4 for reversing the take-up direction of the ink ribbon 8. A pair of connecting members 19 are rotatably supported by the studs 2 at the lower ends of the spool hubs 3.

Each of the connecting members 19 comprises a small disk forming teeth 19*a* and a large disk forming teeth 19*b*. As shown at the left-hand side of FIG. 4 and in FIG. 5, when the sensor 16 is rotated to the position outside of the groove 4, the leg 16*b* of the sensor 16 engages with a tooth 19*a* of connecting member 19, so that the connecting member 19 may be rotated with the spool hub 3. The reverse mechanism 20, driven upon the rotation of the connecting member 19 between two positions for reversing the feeding direction of the ink ribbon 8, will now be described in detail.

Figure 9:
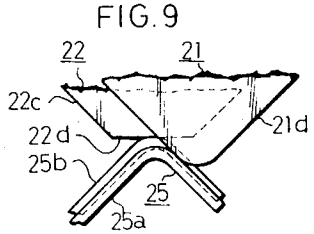
FIG. 9 is an enlarged sectional view showing a part of the reverse mechanism shown in FIG. 8.

First and second members 21, 22 are slidably mounted on the base plate 1 and are located at an intermediate position between said connecting members 19, and are movable on said plate 1 relative to each other in each direction through cooperation of elongated slots 21*a*, 22*a* and a pair of guide pins 23 mounted on the base plate 1. Each end portion of the first member 21 has a projection 21*b* engageable with teeth 19*b* of the respective connecting member 19. A recess 21*c* is formed at the rear part of the first member 21. Two notches 21*d* are continuously formed at the front part of the member 21 so as not to include a flat portion. An angular projection 22*b* is formed at the rear portion of the member 22 and a base portion of the projection 22*b* is adapted to engage said recess 21*c* so as to be movable therein through a predetermined distance L. A cam surface 22*e* is formed at both sides of the projection 22*b*, so that the feed pawl 14 engaging with the cam surface 22*e* through its lug 14*b* is kept disengaged from the corresponding ratchet wheel 3*b* against the action of spring 15. A pair of notches 22*c* having a shape similar to that of notches 21*d* on the first movable member 21 are formed at the front part of the second member 22, and the zone between the two notches 22*c* has a substantially flat surface 22*d*, as shown in FIG. 9.

Figure 6:
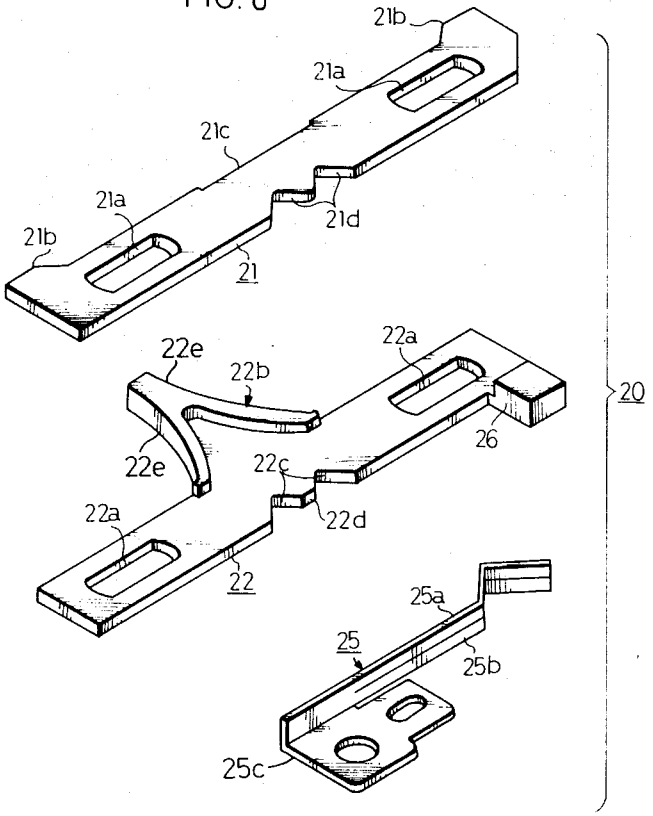
FIG. 6 is an exploded perspective showing various components of the reverse mechanism used in the ink ribbon feed mechanism of FIG. 2.

As shown in FIG. 6, a leaf spring 25, serving as a detent member consists of a base portion 25*c* and a pair of separated spring pieces 25*a*, 25*b* extended from the base portion 25*c*. The base portion 25*c* is adjustably mounted on the base plate 1 by a screw 24, and each of the spring pieces 25*a*, 25*b* has an engaging portion having the shape of the reversed letter "V". The engaging portion of the spring piece 25*a* is selectively engageable with the notches 21*d* of the first member 21 so as to keep the position of the member 21 in either one of two positions thereof. The engaging portion of the spring piece 25*b* is selectively engageable with the notches 22*c* of the second member 22 and positions the member 22 at respective positions of the member 21 so as to be movable a predetermined distance L relative to the member 21.

Figure 7:
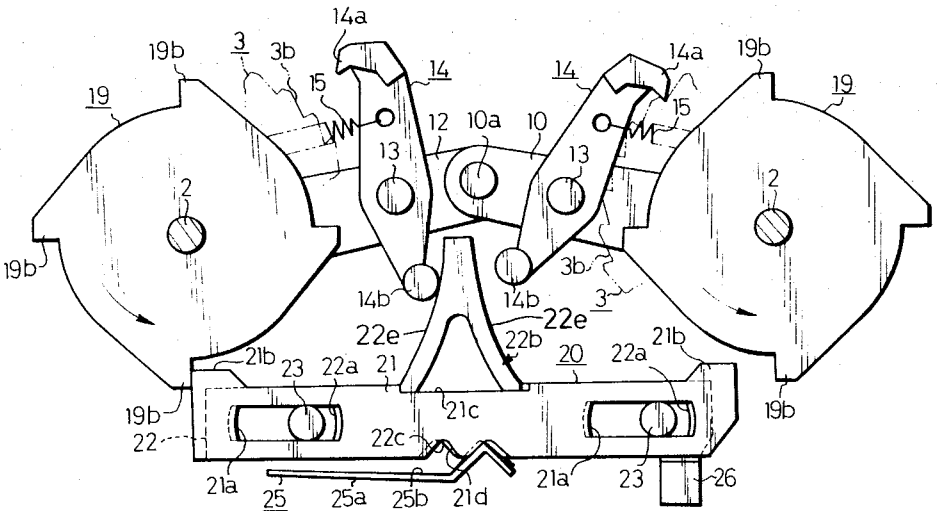
FIGS. 7 and 8 are plan views relative to FIG. 2 and showing different operating modes of the ink ribbon feed mechanism.

When the first and second members 21, 22 are held in their left-hand positions, as shown in FIG. 2, the right-hand side spool hub 3 serves as the take-up side and the left-hand side spool hub 3 serves as the supply side. As mentioned above, when the take-up direction for the ribbon 8 should be reversed, the connecting member 19 of the supply side is rotated with the spool hub 3 upon the sensing movement of the sensor 16, the tooth 19*b* of the connecting member 19 engages with the projection 21*b* on the first member 21, as shown in FIG. 5, and the first member 21 starts to travel from its left-hand position towards its right-hand position. After the first member 21 has travelled a predetermined distance L as shown in FIG. 7 and the left-hand shoulder of recess 21*c* has engaged with the left-hand edge of the projection 22*b* of the second member 22, the second member 22 starts to travel from its left-hand position with the first member 21. Thereafter, at the same time that the first member 21 has completed its rightward movement, thanks to cooperation of the connecting member 19 with the first spring piece 25*a*, the second member 22 is positioned in its right-hand position, due to operation of the second spring piece 25*b*. In this state, the left-hand spool hub 3 serves as the take-up side and the right-hand hub 3 as the supply side, the feed direction of the ink ribbon 8 being now reversed.

In this embodiment, a manually operable projection 26 is formed at the right side of the second member 22 and, as a new cassette 6 is mounted on the spool hubs 3, as shown in FIG. 3, the first and second members 21, 22 are manually moved to their left-hand side positions by operation of projection 26, the right-hand side spool hub 3 serving as the take-up.

The ink ribbon feed mechanism operates in the following manner. In FIGS. 2 and 3, the first and second members 21, 22 are shown in their extreme leftward positions. Thus, the right-hand feed pawl 14 engages with the corresponding ratchet wheel 3*b* and the right-hand spool hub 3 serves as the take-up side, whereas the left-hand hub 3 serves as the supply side, the left-hand feed pawl 14 being disengaged from the corresponding ratchet wheel 3*b* upon the engagement of the lug 14*b* with the cam surface 22*e* of the projection 22*b*. In this state, when the levers 10, 12 are reciprocatingly rotated by operation of the typewriter printing mechanism and through the connecting rod 11, the pawl members 14 are reciprocated between a solid line and a broken line position, as shown in FIG. 2, the right-hand feed pawl 14 operating for turning the corresponding spool hub 3 counterclockwise for a predetermined angular measure. The ink ribbon 8, mounted between the spools 7 on the spool hubs 3, is supplied from the left-hand spool 7 by a predetermined extent during each operation of the printing mechanism and, after being fed rightwards through the printing zone along the front platen surface, is taken up on the right-hand spool 7.

As the ribbon 8 is supplied in this way from the left-hand spool 7 to the right-hand spool 7, and has been absent on the left-hand spool 7, the sensor 16 mounted in the groove 4 on the spool hub 3 is rotated to a position outside the groove 4 under the action of the leaf spring 17, as shown in FIG. 4, the projection 16*b* being then positioned for engaging with the tooth 19*a* of the connecting member 19. In this state, when the left-hand spool hub 3 is turned counterclockwise as shown in FIG. 2 with the sensor 16, the leg 16*b* of the sensor 16 engages with the tooth 19*a* of connecting member 19, and the connecting member 19 is rotated in unison with the spool hub 3. By this rotation, the tooth 19*b* of the connecting member 19 engages with the left-hand projection 21*b* of the first member 21, which is now moved from its left-hand position towards its right-hand position.

Figure 8:
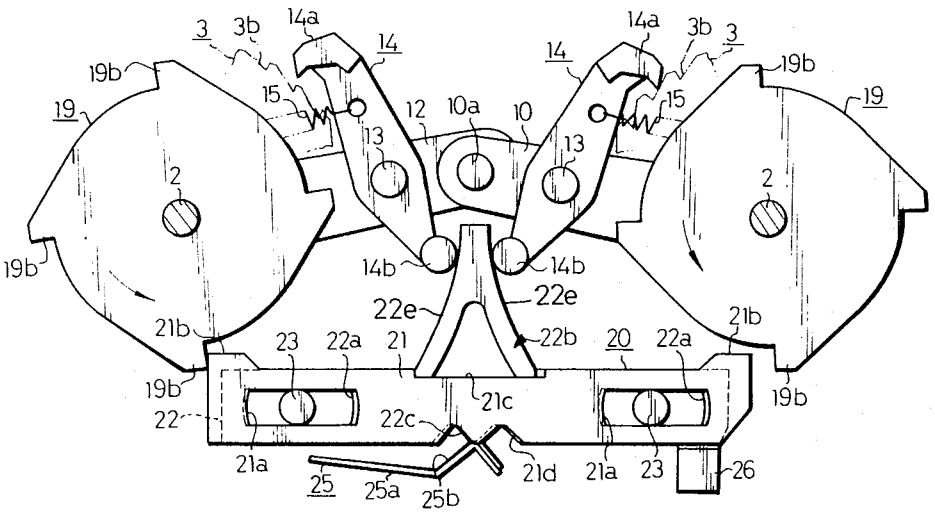

After the first member 21 has travelled a predetermined distance L, as shown in FIG. 7, and the left-hand shoulder of recess 21*c* has engaged with the left-hand edge of the projection 22*b* of the second member 22, the latter member 22 starts to travel from its left-hand position with the member 21. By such movement, as shown in FIGS. 8 and 9, the first spring piece 25*a* of a leaf spring 25 engages with the left-hand notch 21*d* of the first member 21 from the right-hand notch 21*d* over the angular projection, whereas the second spring piece 25*b* disengages from the right-hand notch 22*c* of the second member 22 and engages with the flat surface 22*d*. Thereafter, the member 21 is forcefully moved rightwards under operation of the first spring piece 25*a* and the rotation of the connecting member 19 at the same time that the second member 22 is positioned to its right-hand position by operation of the second spring piece 25*b*.

In this way, the left-hand feed pawl 14 is disengaged from the cam surface 22*e* of the projection 22*b* of the first member 22 and the pawl portion 14*a* thereof engages with the corresponding ratchet wheel 3*b*, by operation of the spring 15, the right-hand feed pawl 14 engaging with the cam surface 22*e* of the projection 22*b* of the second member 22 and disengaging from the corresponding ratchet wheel 3*b*. Thus, the left-hand spool hub 3 serves as the take-up side, whereas the right-hand spool hub 3 serves as the supply side and the ink ribbon 8, placed between the two spools 7, is fed leftwards along the printing position ahead of the front platen surface by operation of the printing mechanism. After completion of such leftward ink ribbon feed operation, the members 21, 22 are moved from the right-hand position towards the left-hand position by operation of sensor 16 at the right-hand spool hub 3 and cooperation between the connecting member 19 and the leaf spring 25, for reversing the feed direction of the ink ribbon 8.

According to this embodiment, as described above, after the first member 21 has travelled a predetermined distance L from its one position with rotation of connecting member 19, the second member 22 is moved along with the first member 21 and, after the first member 21 has travelled over its midposition between its two extreme positions, the first member 21 is moved forcefully towards the other position by cooperation between the connecting member 19 and the spring piece 25*a*, at the same time that the second member 22 is positioned in the other position by the second spring piece 25*b*. Hence, the movement of the members 21, 22 and the feed pawl 14 is not locked up, and the two members 21,22 may be reliably moved from one to the other position for reliably reversing the feed direction of the ink ribbon 8.

What is claimed is:

1. In an ink ribbon feed mechanism for a printing machine of the type comprising a base plate; a pair of spool hubs mounted on said base plate for holding a ribbon spool carrying an ink ribbon, each of said spool hubs having a ratchet wheel coaxially secured thereto to feed the ribbon from one to the other of said spools; a feed device having actuating lever means and a pair of feed pawls pivotally supported on said actuating lever means, each of said pawls associated with a respective one of said ratchet wheels; a pair of springs for biasing said feed pawls causing said feed pawls to engage said ratchet wheels respectively; drive means for reciprocating said actuating lever means in a cycle movement; a reversal device movably mounted on said base plate for movement between a first and a second position, said reversal device causing one of said feed pawls to disengage from said ratchet wheel corresponding thereto for feeding said ribbon from one to the other of said spools in a first direction upon a reciprocal movement of said actuating lever means when said reversal device is located in the first position, and said reversal device causing the other of said feed pawls to disengage from said ratchet wheel corresponding thereto for feeding said ribbon in a second direction opposite to said first direction when said reversal device is located in the second position; a pair of sensing elements for sensing the amount of said ribbon on said spools; connecting means for alternately connecting said sensing elements with said reversal device to move said reversal device from one of the first and second positions to the other upon the sensing movement of said sensing elements, wherein said reversal device comprises:

a first member movably supported by said base plate between the first and second positions and having a recess forming a pair of shoulders, a pair of notches continuously formed so as not to include a flat surface therebetween and a pair of portions engageable with said connecting means;

a first detent member resiliently engaging with either of said notches of said first member for positioning said first member in the first position or the second position;

a second member movably mounted on said base plate between the first and second positions and having a pair of notches formed so as to include a flat surface therebetween and a projection engageable with said feed pawls to keep either of said feed pawls disengaged from said ratchet wheel corresponding thereto, said projection further having a base portion of which a pair of side edges are engageable with said pair of shoulders of said recess;

a second detent member resiliently engaging with either of said notches of said second member for positioning said second member in the first position or the second position so as to provide for a predetermined distance between each of said edges and each of said shoulders corresponding thereto for allowing relative movement between said first and second members, whereby while said first member is moved by said connecting means from said first position thereof to said second position, said second member is moved with said first member after said first member has been moved by the predetermined distance to cause one of said shoulders to engage with the corresponding side edge of said base portion, so that when said first member if further moved reaches the position where said first detent member disengages from one of the notches of said first member and begins to engage with the other notch of said first member, said second member reaches the position where said second detent member disengages from one of said notches of said second member and engages with said flat surface therebetween, then said first and second members are moved to said second position under a forcefully cooperating operation between the first detent member and the other of said notches of said first member and the operation of said connecting means, thereafter the first and second members are positioned in said second position by said first and second detent members respectively, and the feeding of said ribbon is reversed.

2. An ink ribbon feed mechanism according to claim 1 wherein said first and second members have a pair of slots respectively, and said first member is superimposed on said second member mounted on said base plate so as to cause said slots of said first member to coincide with said slots of said second member respectively, and said first and second members are slidably supported by said base plate between said first and second positions through cooperation of said slots and a pair of guide pins mounted on said base plate.

3. An ink ribbon feed mechanism according to claim 1 wherein said projection of said second member has a cam surface on both sides thereof, and each of said feed pawls has a pawl portion engageable with said corresponding ratchet wheel and a lug portion, and when said lug portion of said feed pawl engages with said cam surface corresponding thereto, said pawl portion of said feed pawl is kept disengaged from said corresponding ratchet wheel against the biasing force of said spring during the reciprocal movement of said actuating lever means.

4. An ink ribbon feed mechanism according to claim 1 wherein said first and second detent members comprise a mounted portion adjustably mounted on said base plate and a pair of engaging portions, and each of said engaging portions is engageable with said corresponding notches of said first and second member.

* * * * *